US005135452A

United States Patent [19]

Jones

[11] Patent Number: 5,135,452

[45] Date of Patent: Aug. 4, 1992

[54] APPARATUS FOR TESTING AND/OR EXERCISING MUSCLES OF THE HUMAN BODY

[76] Inventor: Arthur Jones, 1155 N.E. 77th St., Ocala, Fla. 32670

[21] Appl. No.: 542,036

[22] Filed: Jun. 22, 1990

Related U.S. Application Data

[63] Continuation-in-part of Ser. No. 307,706, Feb. 8, 1989, Pat. No. 4,989,859, and a continuation-in-part of Ser. No. 451,129, Dec. 15, 1989, Pat. No. 5,004,230.

[51] Int. Cl.[5] ..... A63B 21/062

[52] U.S. Cl. ..... 482/99; 482/8; 482/134; 73/379

[58] Field of Search ..... 272/70, 72, 73, 117, 272/118, 125, 129, 130, 134, 144, 94; 128/25 R; 73/379

[56] References Cited

U.S. PATENT DOCUMENTS

| | | | |
|---|---|---|---|
| 167,137 | 8/1875 | Tiebout | 272/117 |
| 684,688 | 10/1901 | Herz | 272/117 |
| 3,731,922 | 5/1973 | Jungreis | 272/117 |
| 4,212,480 | 7/1980 | Mikina et al. | 272/73 X |
| 4,227,689 | 10/1980 | Keiser | 272/134 X |
| 4,732,381 | 3/1988 | Skowronski | 272/134 |
| 4,733,859 | 3/1988 | Kock et al. | 272/94 X |
| 4,753,126 | 6/1988 | Sammaratano | 272/134 X |
| 4,763,897 | 8/1988 | Yakata | 272/118 |
| 4,768,779 | 9/1988 | Oehman, Jr. et al. | 272/94 |
| 4,878,663 | 11/1989 | Luqette | 272/134 |

*Primary Examiner*—Robert Bahr

*Attorney, Agent, or Firm*—William E. Mouzavires

[57] ABSTRACT

Apparatus for exercising rotary neck muscles having a compound cam for transmitting forces from the neck muscles through a movement arm and to a resistance weight to lift the weight. A pin mounted to move with the movement arm is receivable in one of a plurality of apertures in the cam to rotate the cam with the movement arm. The cam transmits drive to lift the resistance weight by a cam follower engageable with either of a pair of cam surfaces formed on the periphery of the cam depending upon the direction of rotation of the cam. Adjustable stop mechanisms are also disclosed for limiting the range of angular movement of the movement arm.

13 Claims, 4 Drawing Sheets

APPARATUS FOR TESTING AND/OR EXERCISING MUSCLES OF THE HUMAN BODY

RELATED APPLICATIONS

The present application is a continuation in part of my prior co-pending applications, Ser. No. 07/307,706 filed Feb. 8, 1989, now U.S. Pat. No. 4,989,859, and Ser. No. 07/451129 filed Dec. 15, 1989, now U.S. Pat. No. 5,004,230. The disclosures of each of the aforementioned applications and patents is hereby incorporated by reference into the subject application as part hereof.

OBJECTS OF THE PRESENT INVENTION

The present invention generally relates to methods and apparatus for testing and/or exercising muscles of the human body. More specifically the present invention relates to improvements in the methods and apparatus disclosed in my prior co-pending application, Ser. No. 07/307,706 identified above. Such methods and apparatus relate to testing and/or exercising rotary neck muscles of the human body, however the present invention may also be applied to testing other muscles of the human body.

One of the objects of the present invention is to provide an improved method and apparatus for testing and/or exercising rotary muscles of the human body.

Another object of the present invention is to provide a novel and improved transmission mechanism for interconnecting a resistance to a movement arm which is operated by the muscles being exercised. Included herein is such a transmission mechanism which includes a reduced number of parts thereby reducing friction losses in comparison to mechanisms of the prior art.

SUMMARY OF INVENTION

In one preferred embodiment of the invention, the movement arm is rotatable in either direction about a first axis in response to forces generated by the muscles to be exercised. In the specific embodiment shown, the muscles are the rotary neck muscles which transmit forces to the movement arm through means of head pads engaged on opposite sides of the head. When the rotary muscles on one side of the neck are being exercised, the head pads will be rotated in that direction to rotate the movement arm in one direction about a vertical axis; and when the rotary neck muscles on the opposite side of the neck are being tested the head pads and in turn the movement arm will rotate in the opposite direction. Opposing the movement arm is a resistance preferably one or more dead weights which are connected to the movement arm by a novel and improved transmission system in accordance with the present invention. In the preferred embodiment the transmission means includes a "compound" cam mounted for movement about a vertical axis and having first and second cam surfaces spaced along its periphery. A cam follower is engageable with either of the cam surfaces depending on the direction of rotation of the movement arm, to transmit force to the resistance to move the resistance. In the specific embodiment shown, the cam follower is mounted on a pivotable lever having a connecting link connected to a pulley to rotate the same. The pulley has fixed thereto a cable or chain connected to the resistance weight.

In the specific embodiment shown, the cam is connected to the movement arm by means of a pin receivable in one of a plurality of apertures in the cam. The pin is mounted in a mounting member connected to the movement arm in the specific embodiment by means of a strain gauge. When the pin is received in the cam aperture, the cam is connected to the movement arm to be rotated thereby which in turn will of course move the resistance weight. When the pin is removed from the cam aperture, the movement arm is disengaged from the resistance weight.

The cam is also provided with a lock mechanism for locking the cam in position against rotation. This fixed position of the cam may be utilized for static strength tests where the static strength of the muscles will be measured through the strain gauge.

In addition, the apparatus also includes an adjustable stop for limiting the range of movement of the movement arm. The stop is adjustable to increase or decrease the range of movement to suit a particular subject being exercised.

DRAWINGS

Other objects and advantages of the present invention will become apparent from the following more detailed description of the accompanying drawings in which.

Figure 3:
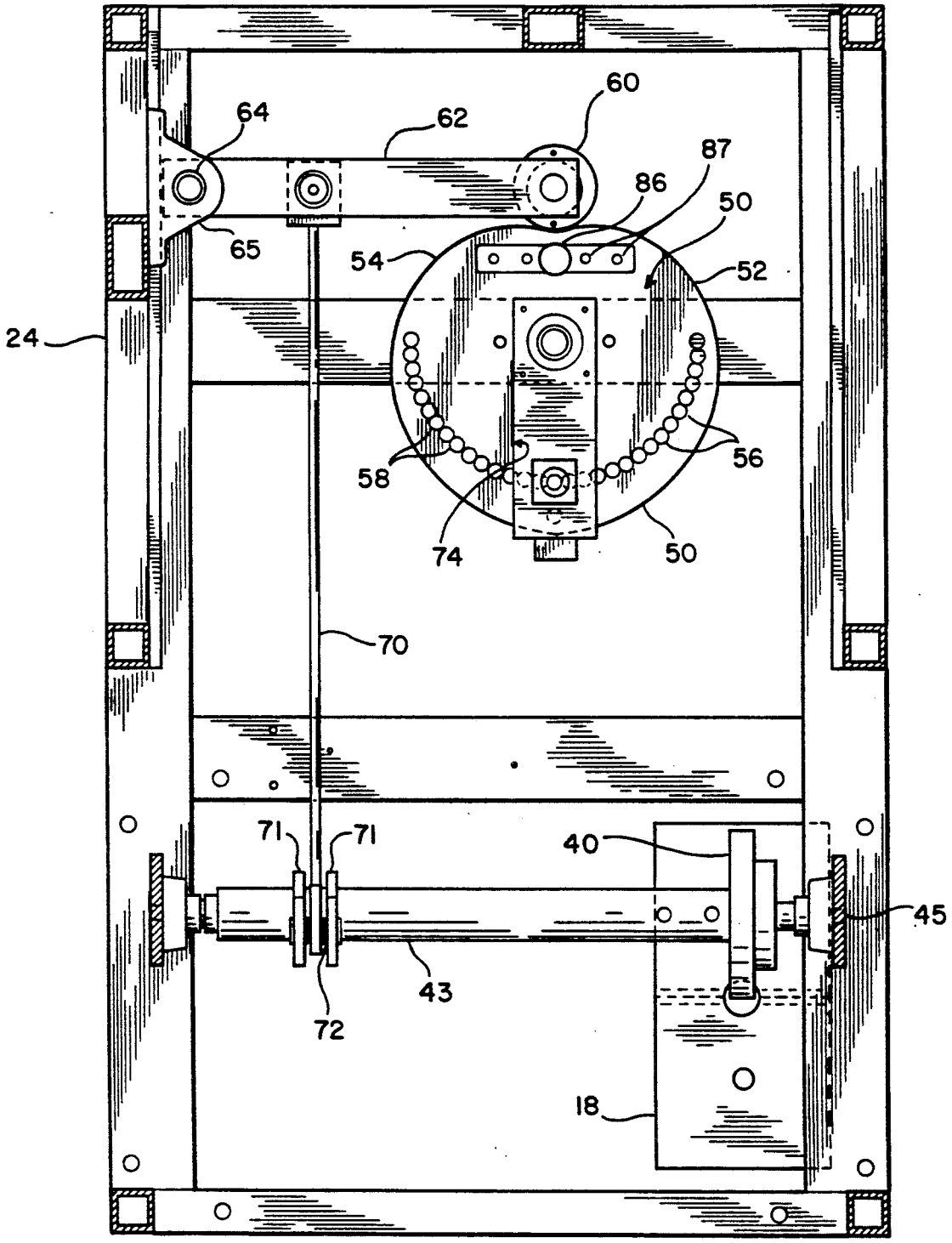
Figure 4:
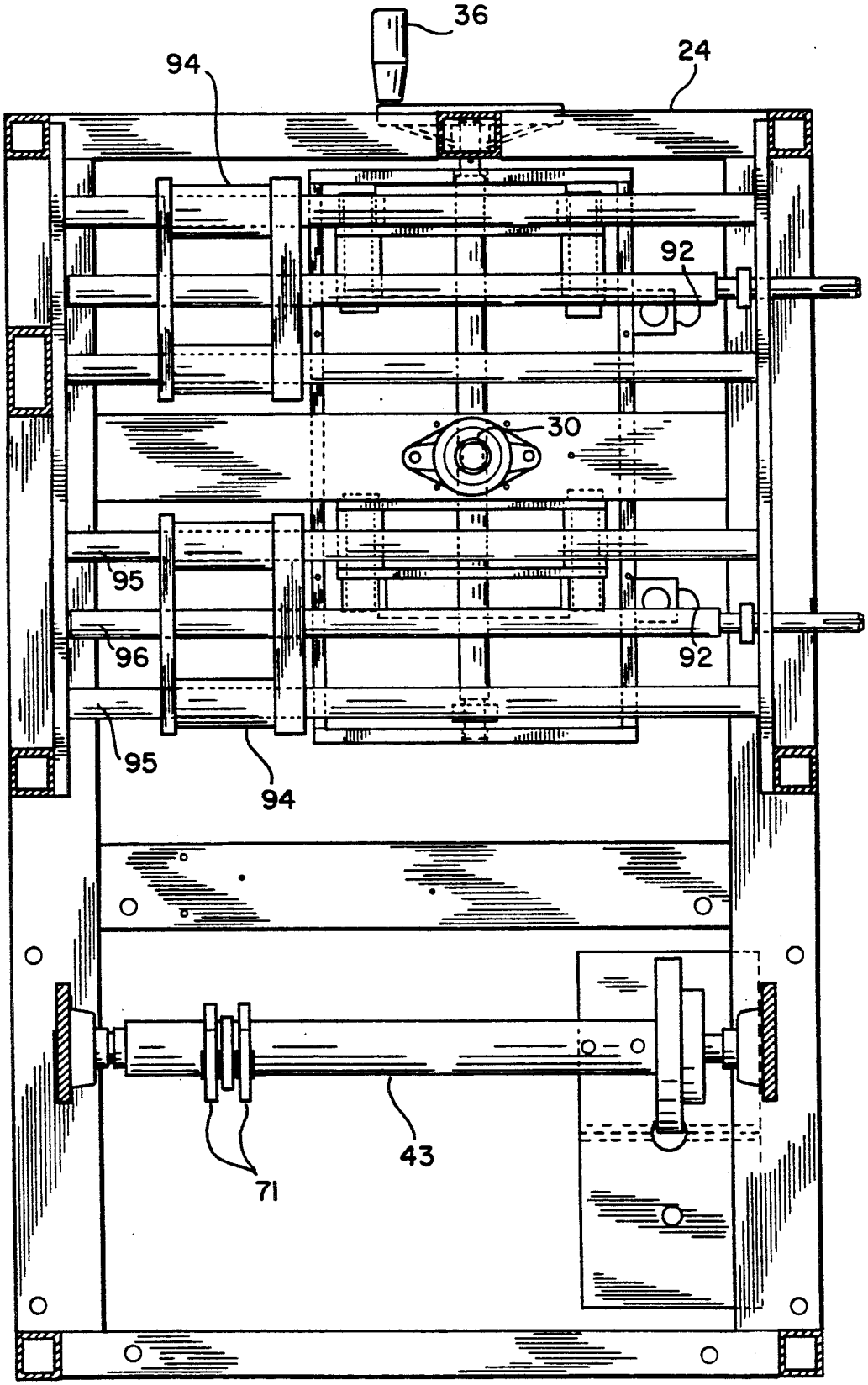

FIG. 3 is an enlarged plan view of an upper section of the apparatus showing a motion transmission system including a compound cam and with certain parts removed and certain parts shown in cross-section; and FIG. 4 is a plan view of an upper section of the apparatus illustrating an adjustable stop mechanism included in the apparatus and with certain parts removed and other parts shown in cross-section.

DETAILED DESCRIPTION

Figure 1:
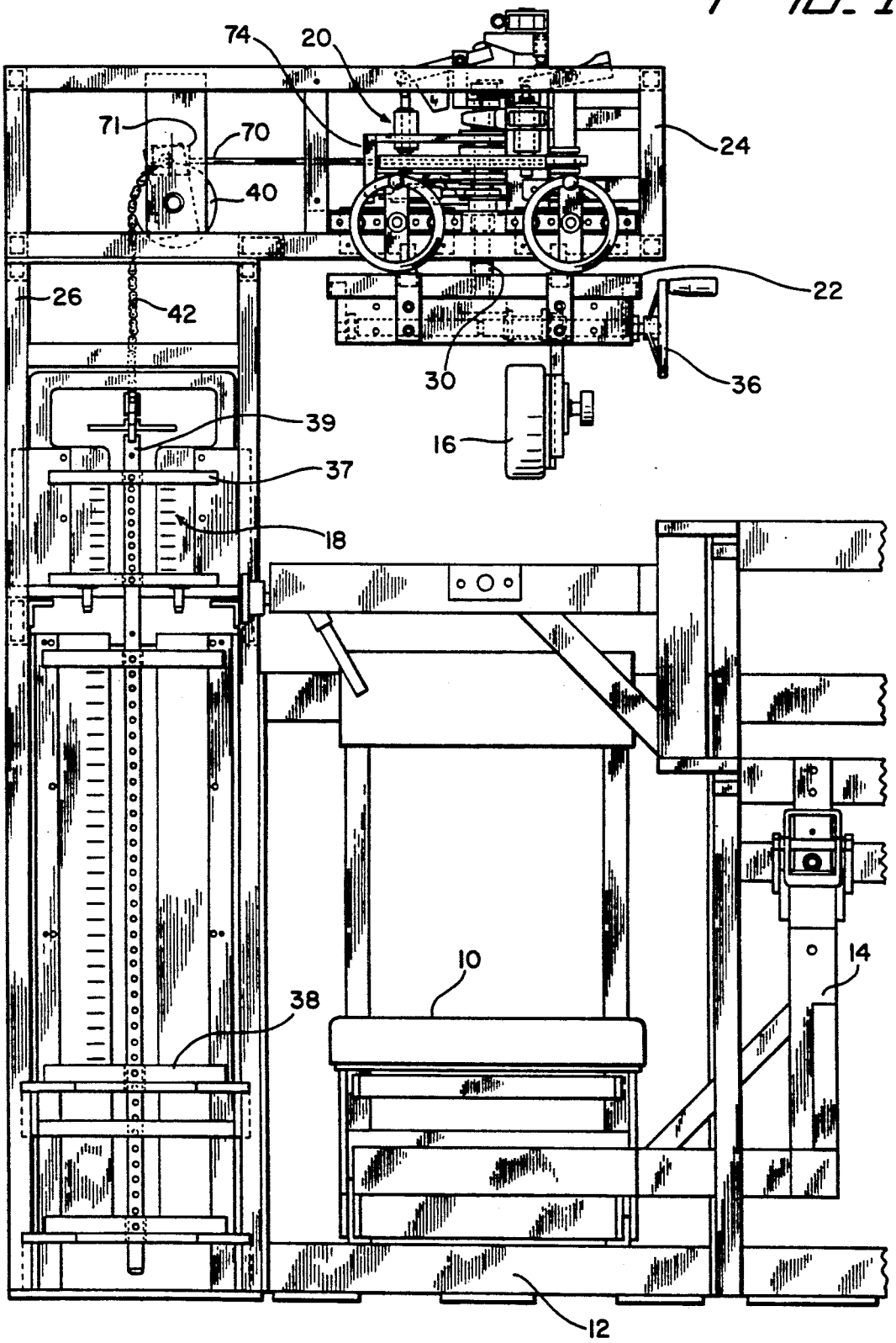
FIG. 1 is a front elevational view of apparatus constituting a preferred embodiment of the present invention and with certain portions removed for clarity.

Referring now to the drawings in detail, there is shown for illustrative purposes only, apparatus constituting a preferred embodiment of the present invention; the apparatus being utilized for exercising and/or testing rotary muscles of the human neck. With reference initially to FIG. 1, the apparatus includes a seat 10 mounted on a frame the base of which is shown at 12 for receiving a person to be exercised and/or tested. Seat 10 is adjustable through a mechanism 14 the details of which may be obtained from my prior co-pending application, Ser. No. 07/307,706 identified above. When seated, the rotary neck muscles to be exercised are isolated from the torso by means of one or more chest pads which secure the upper torso against a backrest; a more detailed description of these parts may be obtained from my above-identified co-pending application.

Forces are generated from the rotary neck muscles to a pair of head pads 16 only one being shown in FIG. 1. Head pads 16 are engageable with the opposite sides of the subject's head so that when the subject rotates his head about the neck axis in one direction, it will serve to lift one or more resistance weights from a weight stack generally designated 18, and when the subject return his head to the starting position the weights will be lowered to their original position. Movement of the head pads 16 is transmitted to the resistance weight by means of a transmission system generally designated 20 in FIG. 1 in accordance with the present invention.

Head pads 16 are suspended from a frame generally designated 22 which is mounted for rotation about a vertical axis by means of a vertical shaft 30 fixed to the frame 22 and mounted in a stationary frame generally designated 24 which is supported from the top of a vertical frame 26 as best shown in FIG. 1. Head pads 16, frame 22 and movement arm shaft 30 in effect constitute a movement arm which responds to forces generated by the rotary neck muscles to rotate the movement arm about the vertical axis passing through the shaft 30. Such motion is transmitted to the weight stack 18 by a transmission generally designated 20 to raise the resistance weight which of course imposes a load which must be overcome by the neck muscles in order to rotate the movement arm about the vertical axis.

Figure 2:
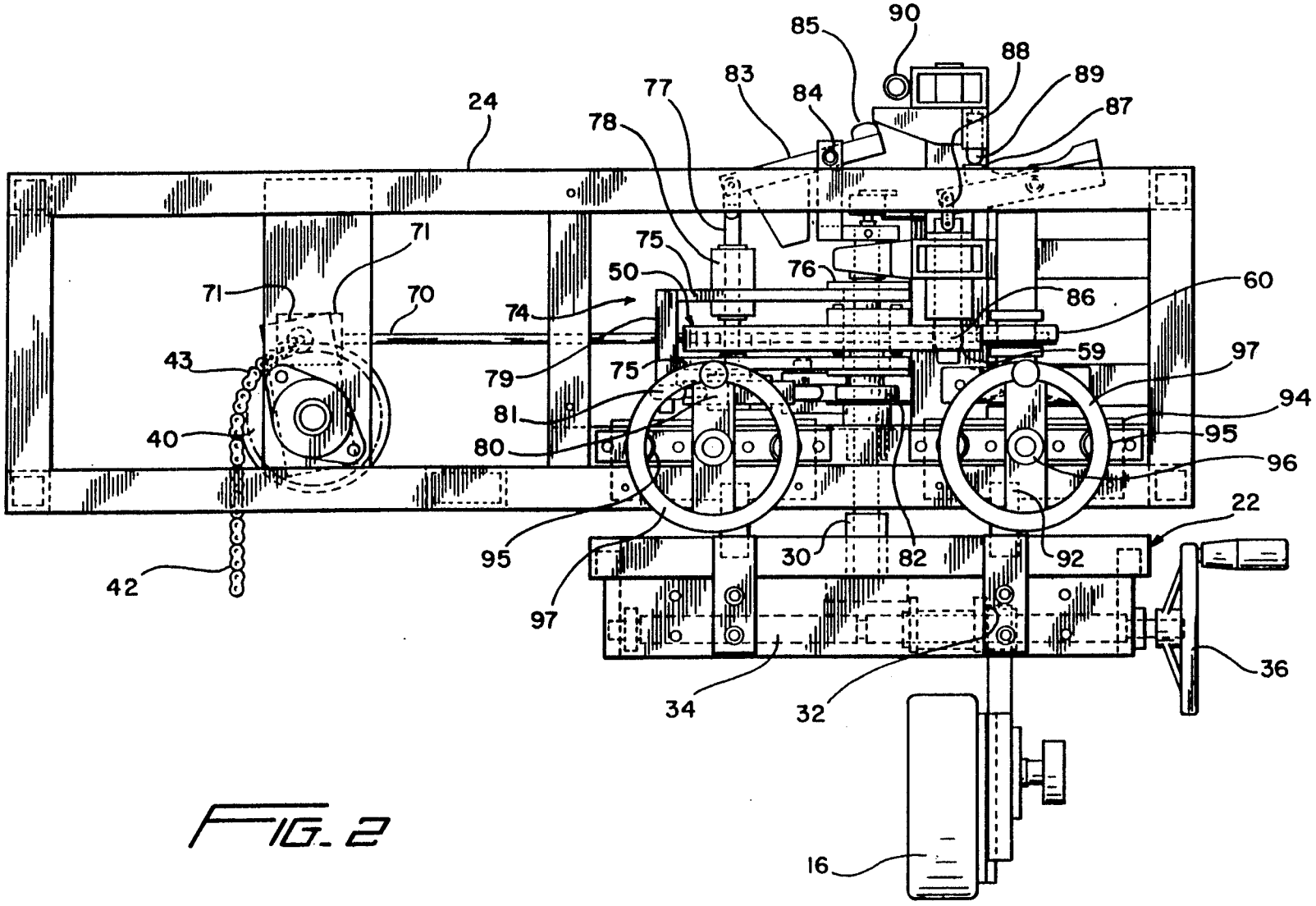
FIG. 2 is a view similar to FIG. 1 but only of the upper section of FIG. 1 which has been enlarged.

Referring to FIG. 2, the head pads 16 are mounted on and suspended from nut mechanisms 32 which are mounted about horizontal screws 34 which are rotated by handwheel 36 to adjust the head pads towards or away from the opposite sides of the subject's head.

Transmission 20 includes in the preferred embodiment a yoke generally designated 74 having upper and lower arms 75 mounted about the movement arm shaft 30 and a cross-piece 79 interconnecting arms 75. Slidably carried in a sleeve 78 of the yoke 74, is a pin 77 adapted to be received in one of a plurality of two sets of apertures 56 and 58 extending vertically through a cam 50 as best shown in FIG. 3. Cam 50 is a "compound" cam in accordance with the present invention and is mounted for rotation about the movement arm shaft 30 when it is connected to the movement arm by means of the yoke 74, slide pin 78 and a connecting member 80 which interconnects the yoke 74 to the movement arm shaft 30. In the preferred embodiment shown, the connecting member is a strain gauge having one end 81 connected to the yoke 74 and opposite end 82 connected to the shaft 30. Cam apertures 56 and 58 are angularly spaced from each other at predetermined positions to allow static strength tests on the subject's muscles to be performed at any or all of the different angular positions of the neck about the vertical axis of the neck as will be described below.

Slide pin 77 is actuated by means of a lever 83 pivoted intermediate its ends at 84 to be actuated through a handle connected to lever 83 at 85. Rotation of the lever in a clockwise direction as viewed in FIG. 2 will of course raise the pin 77 to remove it from the apertures 56 or 58.

In order to lock the cam 50 in adjusted position, a lock mechanism is provided which in the preferred embodiment includes a locking pin 86 receivable in apertures 59 of the cam 50 to lock the cam 50 against rotation. Locking pin 86 is actuated through a lever 87 connected to the locking pin 86. Lever 87 in turn is actuated through another lever 90 which will raise or lower finger 89 engageable with lever 87. When finger 89 is depressed, lever 87 will be pivoted counter-clockwise as viewed in FIG. 2 to move locking pin 86 downwardly into aperture 59 to lock the cam 50. Conversely when finger 89 is raised, lever 87 can be pivoted clockwise to remove locking pin 86 from the cam 50 to allow cam 50 to rotate. Apertures 87 on opposite sides of locking apertures 59 in the cam 50 are used to receive screws or bolts for mounting adjusting plates for precisely sizing locking aperture 59.

In accordance with the present invention, rotation of cam 50 is transmitted to the weight stack to raise the resistance weight by means of a cam follower including a roller 60 rotatably mounted on a cam follower lever 62 which in turn is pivoted at 64 by a bearing 65 to the frame 24 as best shown in FIG. 3. Cam 50 has a pair of cam surfaces 52 and 54 each having a predetermined arcuate shape formed on opposite portions of the cam 50 to engage cam follower 60 to pivot it about pivot 64 in a clockwise or counter-clockwise direction depending upon the direction of rotation of cam 50. If the muscles on one side of the neck are being exercised, one of the cam surfaces 52 or 54 will come into play and if the neck muscles on the other side of the neck are being exercised, the other cam surface will come into play. It should be pointed out however that the cam surfaces 52 and 54 are specifically designed so that regardless of which one comes into play, the cam follower lever will be pivoted the same angular amount for the same angular extent of rotation of the movement arm. Movement of cam follower lever 62 is transmitted to the weight stack by means of a connecting link 70 which in the specific embodiment is a rod having one end connected to a spherical ball bearing mounted on lever 62. The other end of the connecting link 70 is received in another bearing 72 mounted in plates 71 fixed to a shaft 43 which is mounted for rotation about a horizontal axis in suitable bearings 45 mounted in the frame. As shown in FIGS. 2 and 3, shaft 43 has fixed to it a pulley 40 for rotation with shaft 43 to raise or lower a cable or chain 42 which is fixed to pulley 40 and trained about a portion of the periphery of pulley 40 as best shown in FIG. 2. Weight stack chain 42 is connected to a rod 39 which passes through upper and lower groups of weights 37 and 38 which are independent of each other and may be selectively secured to rod 39 by a key receivable through apertures in the weights and in the rod 39. A more detailed description of a compound weight stack which may be utilized may be found in U.S. Pat. No. 4,834,365 whose disclosure is hereby incorporated by reference into the subject application as part hereof.

In order to limit the range of angular movement of the head pads 16 and in turn the angular movement of the neck of the subject, a pair of range stops generally designated 94 is provided as best shown in FIG. 4. Each range stop 94 in the specific embodiment shown includes a pair of sleeves mounted on parallel guide rods 95 extending forwardly and rearwardly in the upper frame 24 of the apparatus below the level of the cam 50 and yoke 74 described above. Stops 94 are movable along guide rods 95 by a screw 96 which is threaded within a portion of the stops 94 and which is rotatable by handwheels 97 shown in FIGS. 1 and 2. Rotation of handwheels 97 in one direction will move stops 94 along guide rods 95 towards the head pad frame 22 and rotation of the handwheels 97 in the opposite direction will move stops 94 away from head pad frame 22. Stops 94 are engageable with stops 92 fixed to the head pad frame 22 as best shown in FIGS. 2 and 4. As best shown in FIG. 4, there are two sets of stops 94 and 92 provided on opposite sides of the movement arm pivot shaft 30 to come into play depending on the direction of rotation of the movement arm. In other words when one side of the rotary neck muscles is being exercised, one set of stops will come into play to limit the range of movement and when the rotary neck muscles on the opposite side are being exercised, the other set of stops 92 and 94 will come into play.

In one typical use of the apparatus, a subject is seated on seat 10 and secured at the upper shoulder and chest area to a backrest by chest pads so that the upper torso is immobilized and the rotary neck muscles are isolated from the upper torso. The subject is then asked to rotate his head to both sides to determine the range of movement to be utilized during the exercise and the handwheels 97 are rotated to bring the adjustable range stops 94 into the proper position for the particular subject. Handwheels 36 are then rotated to bring the head pads 16 into engagement with the opposite sides of the subject's head.

The static strength of the rotary muscles on one side of the neck is first tested in each of a plurality of different angular positions of the neck which positions are determined by the slide pin 77 being inserted into an appropriate aperture 56 or 58 of cam 50 depending on the angular position desired. The cam 50 is locked in that position by insertion of locking pin 86 into aperture 59 of the cam. The subject is then asked to exert a force with his rotary neck muscles against the pads 16 and the force is measured by the strain gauge 80 and recorded in a computer and displayed on a video screen. After each such test, pins 77 and 86 are removed from cam 50, movement arm shaft 30 and yoke 74 are rotated into the next angular position for testing, and then the pins 77 and 86 are reinserted into the cam 50 and the static strength test is repeated and recorded at that position.

After the static strength test of the rotary neck muscles on one side of the neck is completed, the same test is repeated for the muscles on the opposite side of the neck. When that test is completed, the locking pin 86 is removed from the cam 50 to ready the device for exercising the rotary neck muscles which exercise is a dynamic exercise as opposed to static. In this exercise, the subject is asked to apply with his rotary neck muscles on one side of the neck a force against the head pad 16 in one direction to rotate the movement arm in one direction against a load provided by the resistance weights of the compound weight stack. The force is applied slowly and steadily to lift the weight which is accomplished by positive work and at the conclusion the subject is asked to return his head to the starting position thus performing negative work and during which the resistance weight is lowered to its starting position. The subject is asked to repeat the aforementioned step to again lift the resistance weight and then lower the resistance weight and this process is repeated until the subject can no longer lift the resistance weight due to fatigue in the muscles being exercised. At that point the muscles on the opposite side of the neck are subject to the same dynamic exercise until those muscles fatigue and can no longer lift the resistance weight. As noted above, during dynamic exercise of the muscles on one side of the neck, one of the cam surfaces 52 and 54 will come into play to engage cam follower 60, pivot cam follower lever 62 and rotate shaft 43 to lift the resistance weight, and when the rotary neck muscles on the opposite side of the neck are exercised the other of the cam surfaces 52 and 54 will come into play to actuate cam follower lever 62, shaft 43 and to lift the resistance weight. During each dynamic exercise of the muscles, the subject is asked to begin with his head pointing towards one side (preferably 60 towards one side) as opposed to a straight ahead or normal position of the head. The exercise is begun, that is, the weight begins to be lifted at that starting position where the head is directed towards one side and then the subject continues to move his head towards the opposite side while lifting the resistance weight and performing positive work.

In order to avoid injury to the muscles, the resistance weight chosen for the dynamic exercise is less, preferably substantially less, than the maximum static strength of the muscles being tested. The maximum static strength of the muscles being tested is first determined as indicated by the static tests described above. In addition, during the dynamic exercise of the muscles, the apparatus is specifically designed so that the weights are lifted over an exceedingly short stroke say on the order of 1½ inches thus averting any substantial kinetic energy that could cause injury to the muscles upon return of the weights to their starting position.

After the dynamic exercise of the muscles is completed, the muscles may be again subject to static strength tests to determine the effect of dynamic exercise on the static strength of the muscles. Such information is very useful in determining muscle fibre type and in designing an exercise program for the particular subject. For a further description of the method utilizing the apparatus, reference may be had to my co-pending application, Ser. No. 07/307,706 identified above.

It will be seen that the novel compound cam 50 utilized in the transmission system of the present invention not only reduces parts that have been heretofore required in machines such as the present, but it also does so while increasing the leverage that is available for lifting the weights. In addition the cam system decreases friction in the transmission thus allowing for greater accuracy of measurement and efficiency in performance.

Although the compound cam transmission system of the present invention has been shown and described in conjunction with apparatus for exercising or testing rotary neck muscles, the compound cam system may be employed in other types of exercise apparatus and therefore need not be limited to rotary neck apparatus. Rather the scope of protection will be indicated in the appended claims.

What is claimed is:

1. Apparatus for exercising muscles of the human body, the apparatus comprising in combination, a movement arm rotatable in opposite directions about a first axis in response to forces generated by said muscles to be exercised, resistance means for opposing movement of said movement arm about said first axis, and transmission means connecting said movement arm to said resistance means including a cam mounted for rotation about said first axis in opposite directions and having first and second spaced surfaces, and a cam follower engageable with either of said first and second cam surfaces depending upon the direction of rotation of said cam about said first axis and wherein said transmission means includes a shaft rotatable about a second axis, a cable or chain connected to said shaft to be rotatable therewith and also being connected to said resistance means to move said resistance means upon rotation of said shaft, and a connecting link interconnecting said cam follower and said shaft.

2. Apparatus defined in claim 1 wherein said cam follower is mounted for pivotal movement about a third axis.

3. Apparatus defined in claim 2 wherein said shaft has a pulley fixed thereto and said chain or cable is fixed to said pulley.

4. Apparatus defined in claim 1 wherein said resistance means includes one or more dead weights to be lifted upon rotation of the movement arm in one direction and to be lowered upon return movement of said movement arm in a direction opposite said one direction.

5. Apparatus defined in claim 1 wherein said transmission means further includes a plurality of apertures in said cam, and a pin receivable in one of said apertures.

6. Apparatus defined in claim 5 wherein said transmission means includes a mounting member slidably receiving said pin and a strain gauge interconnecting the mounting member and said movement arm.

7. Apparatus defined in claim 1 wherein there is further including locking means for locking said cam, said locking means including an aperture in said cam and a locking pin receivable in said cam to lock the cam against rotation.

8. Apparatus defined in claim 1 wherein said first axis is a generally vertical axis and said cam extends in a generally horizontal plane.

9. Apparatus defined in claim 8 including a pair of opposed head pads engageable with the opposite sides of the head and being connected to the movement arm to rotate the movement arm about said first axis under forces generated by rotary neck muscles of the human body.

10. Apparatus defined in claim 8 including a stop engageable with the movement arm to limit the range of movement about said axis, and means mounting said stop for movement towards or away from the movement arm to adjust the range of movement of said movement arm.

11. Apparatus defined in claim 1 including a stop engageable with the movement arm to limit the range of the movement arm about said axis, and means mounting said stop for movement towards or away from the movement arm to adjust the range of movement of said movement arm.

12. Apparatus defined in claim 1 wherein said cam follower includes a pivotable lever, a connecting link connected to the lever, and a shaft rotatable by the connecting link when the lever is pivoted by said cam.

13. Apparatus for exercising muscles of the human body, the apparatus comprising in combination, a movement arm rotatable in opposite directions about a first axis in response to forces generated by said muscles to be exercised, resistance means for opposing movement of said movement arm about said first axis, and transmission means connecting said movement arm to said resistance means including a cam mounted for rotation about said first axis in opposite directions and having first and second spaced surfaces, and a cam follower engageable with either of said first and second cam surfaces depending upon the direction of rotation of said cam about said first axis and wherein said transmission means further includes a plurality of apertures in said cam, and a pin receivable in one of said apertures, and wherein said transmission means includes a mounting member slidably receiving said pin and a strain gauge interconnecting the mounting member and said movement arm.

* * * * *